US008065989B2

(12) United States Patent
Reichelt

(10) Patent No.: US 8,065,989 B2
(45) Date of Patent: Nov. 29, 2011

(54) FUEL DELIVERY DEVICE

(75) Inventor: Sabine Reichelt, Rodgau-Jügesheim (DE)

(73) Assignee: Continental Automotive GmbH, Hannover (DE)

( * ) Notice: Subject to any disclaimer, the term of this patent is extended or adjusted under 35 U.S.C. 154(b) by 374 days.

(21) Appl. No.: 12/160,653

(22) PCT Filed: Dec. 18, 2006

(86) PCT No.: PCT/EP2006/069809
§ 371 (c)(1),
(2), (4) Date: Jul. 11, 2008

(87) PCT Pub. No.: WO2007/082616
PCT Pub. Date: Jul. 26, 2007

(65) Prior Publication Data

US 2010/0154751 A1 Jun. 24, 2010

(30) Foreign Application Priority Data

Jan. 13, 2006 (DE) ..... 10 2006 001 878

(51) Int. Cl.
*F02M 37/00* (2006.01)
*F02M 37/04* (2006.01)

(52) U.S. Cl. ..... 123/509; 123/510; 123/458

(58) Field of Classification Search ..... 123/509, 123/497, 458, 510
See application file for complete search history.

(56) References Cited

U.S. PATENT DOCUMENTS 4,920,942 A * 5/1990 Fujimori et al. ..... 123/497
4,926,829 A * 5/1990 Tuckey ..... 123/497
4,928,657 A * 5/1990 Asselin ..... 123/514
5,044,344 A * 9/1991 Tuckey et al. ..... 123/497
5,120,201 A * 6/1992 Tuckey et al. ..... 417/366
5,148,792 A * 9/1992 Tuckey ..... 123/497
5,261,379 A * 11/1993 Lipinski et al. ..... 123/520
5,267,470 A * 12/1993 Cook ..... 73/49.7
5,361,742 A * 11/1994 Briggs et al. ..... 123/506
5,398,655 A * 3/1995 Tuckey ..... 123/456
5,404,756 A * 4/1995 Briggs et al. ..... 73/718
5,406,922 A * 4/1995 Tuckey ..... 123/497
5,411,002 A * 5/1995 Smitley ..... 123/497
5,613,844 A * 3/1997 Tuckey et al. ..... 417/366
5,621,176 A * 4/1997 Nagano et al. ..... 73/714
5,785,025 A * 7/1998 Yoshiume et al. ..... 123/497
5,961,293 A * 10/1999 Clemmons et al. ..... 417/44.2
6,131,445 A * 10/2000 Kundrot et al. ..... 73/114.38
6,223,731 B1 * 5/2001 Yoshiume et al. ..... 123/497
6,302,144 B1 * 10/2001 Graham et al. ..... 137/565.17
6,474,310 B2 11/2002 Joos et al. ..... 123/497
6,776,141 B2 * 8/2004 Hamada et al. ..... 123/458

(Continued)

FOREIGN PATENT DOCUMENTS

DE 100 06 622 A1 8/2001

(Continued)

*Primary Examiner* — Thomas Moulis
(74) *Attorney, Agent, or Firm* — King & Spalding L.L.P.

(57) ABSTRACT

In a fuel delivery device (1) for supplying an internal combustion engine (3) of a motor vehicle with fuel from a fuel tank (2), a pressure sensor (14) is arranged within the fuel tank (2) and is connected to a section, which is guided within the fuel tank (2), of a feed line (6). In this way, the pressure sensor (14) is remote from the internal combustion engine (3) and is therefore subjected to only very low thermal and mechanical loads. The fuel delivery line (1) is therefore of particularly cost-effective design.

18 Claims, 3 Drawing Sheets

U.S. PATENT DOCUMENTS

| | | | | |
|---|---|---|---|---|
| 6,802,210 | B2 | 10/2004 | Mitani et al. | 73/118.1 |
| 7,377,253 | B2 * | 5/2008 | Washeleski et al. | 123/198 D |
| 7,383,821 | B2 * | 6/2008 | Gras et al. | 123/509 |
| 7,406,871 | B2 * | 8/2008 | Sugiura | 73/592 |
| 7,418,951 | B2 * | 9/2008 | Hazama | 123/509 |
| 7,458,365 | B2 * | 12/2008 | Hazama | 123/509 |
| 7,743,750 | B2 * | 6/2010 | Ritz et al. | 123/509 |
| 2005/0229906 | A1 * | 10/2005 | Hosoya | 123/457 |
| 2007/0108856 | A1 | 5/2007 | Gras et al. | 310/68 |

FOREIGN PATENT DOCUMENTS

| | | | |
|---|---|---|---|
| EP | 1 059 430 | A1 | 12/2000 |
| WO | WO 2005/052349 | A1 | 6/2005 |

* cited by examiner

FUEL DELIVERY DEVICE

CROSS-REFERENCE TO RELATED APPLICATIONS

This application is a U.S. national stage application of International Application No. PCT/EP2006/069809 filed Dec. 18, 2006, which designates the United States of America, and claims priority to German application number 10 2006 001 878.8 filed Jan. 13, 2006, the contents of which are hereby incorporated by reference in their entirety.

TECHNICAL FIELD

The invention relates to a fuel delivery device for supplying an internal combustion engine of a motor vehicle with fuel from a fuel tank, having an electromotively driven fuel pump which is arranged in the fuel tank, having a feed line which is connected to the fuel pump and which leads to the internal combustion engine, and having a pressure sensor for determining the pressure of the fuel fed to the internal combustion engine.

BACKGROUND

Fuel delivery devices of said type which have a pressure sensor deliver fuel as a function of the demand of the internal combustion engine, and are known from practice. The fuel pump generates a designated pressure and is activated by control electronics according to the values of the pressure sensor. In the fuel delivery devices known from practice, the pressure sensor is arranged on an injection rail of the internal combustion engine. In this way, the pressure sensor permits the precise measurement of the pressure generated by the fuel pump at the internal combustion engine. A disadvantage of the known fuel delivery device is however that the pressure sensor on the internal combustion engine is subjected to intense vibration and very high temperatures. The temperatures at the injection rail of the internal combustion engine are often 110° C. The fuel delivery device according to the invention therefore requires a highly temperature-resistant and vibration-resistant and therefore expensive pressure sensor.

SUMMARY

A fuel delivery device of the type specified in the introduction can be refined in such a way that it can be produced particularly cost-effectively. According to an embodiment, a fuel delivery device for supplying an internal combustion engine of a motor vehicle with fuel from a fuel tank, may comprise an electromotively driven fuel pump which is arranged in the fuel tank, a feed line which is connected to the fuel pump and which leads to the internal combustion engine, and a pressure sensor for determining the pressure of the fuel fed to the internal combustion engine, wherein the pressure sensor is connected to a section of the feed line which is remote from the internal combustion engine.

According to a further embodiment, the pressure sensor may be connected to a section, which is guided within the fuel tank, of the feed line. According to a further embodiment, the pressure sensor may be formed as a structural unit with the fuel pump. According to a further embodiment, a fine filter, the pressure sensor, a pressure regulator and a non-return valve can be formed as a structural unit. According to a further embodiment, contact terminals for connecting the pressure sensor to control electronics for demand control of the fuel pump can be arranged in a flange which closes off an assembly opening of the fuel tank. According to a further embodiment, the pressure sensor can be arranged in a flange, which closes off an assembly opening of the fuel tank, of the fuel pump. According to a further embodiment, the pressure sensor can be arranged between the fuel pump and the fine filter as viewed in the flow direction. According to a further embodiment, the pressure sensor can be arranged directly upstream of a connection, which leads away from the flange, of the feed line. According to a further embodiment, the pressure sensor can be arranged upstream of the non-return valve as viewed in the flow direction.

BRIEF DESCRIPTION OF THE DRAWINGS

The invention permits numerous embodiments. To further clarify its basic principle, a plurality of these are illustrated in the drawing and are described below. In the drawing.

DETAILED DESCRIPTION

Figure 1:
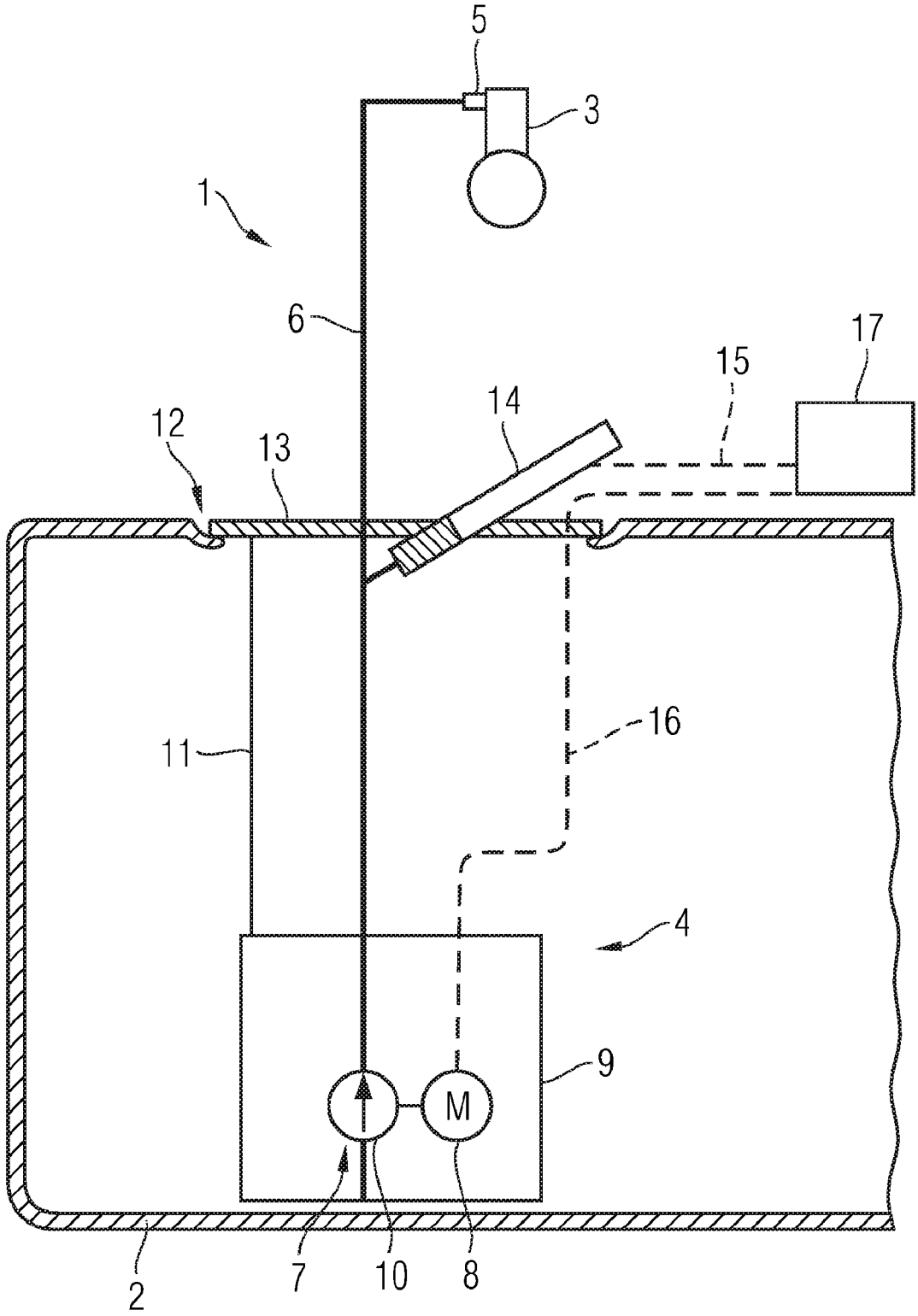
FIG. 1 schematically shows a fuel delivery device according to an embodiment, FIG. 2 schematically shows a partial region of a further embodiment of a fuel delivery device, FIG. 3 schematically shows a partial region of a further embodiment of a fuel delivery device, with a pressure sensor arranged downstream of a non-return valve, FIG. 4 schematically shows a partial region of a further embodiment of a fuel delivery device, with a pressure sensor arranged within a fuel tank.

According to various embodiments, the pressure sensor can be connected to a section, which is remote from the internal combustion engine, of the feed line.

By means of this design, the pressure sensor is arranged remote from the internal combustion engine. Vibrations of the internal combustion engine are therefore not transmitted to the pressure sensor. Furthermore, high temperatures generated by the internal combustion engine are not transmitted to the pressure sensor according to various embodiments. The pressure sensor is therefore exposed only to the temperature, a maximum of 60°, of the fuel in the feed line. In this way, it is possible to use a particularly cost-effective pressure sensor. The fuel delivery device according to various embodiments is particularly cost-effective as a result.

A possible escape of fuel vapors from the pressure sensor into the atmosphere can be prevented in a simple manner according to one advantageous refinement if the pressure sensor is connected to a section, which is guided within the fuel tank, of the feed line. In this way, a connection of the pressure sensor to the feed line is not in contact with the environment, such that fuel escaping at the pressure sensor as a result of leakage or diffusion remains within the fuel tank. The pressure sensor is preferably likewise arranged within the fuel tank.

The fuel delivery device according to various embodiments is particularly simple to assemble if the pressure sensor is formed as a structural unit with the fuel pump. The fuel pump generally has a structural unit with a surge pot and a flange which closes off an assembly opening of the fuel tank. The pressure sensor can therefore be fastened in a simple manner to one of said components, and is assembled during the assembly of the fuel pump in the fuel tank. Furthermore, this design makes it possible for the pressure sensor and the demand control of the fuel pump to be easily tested from outside the fuel tank.

The fuel delivery device according to various embodiments can be produced in a particularly cost-effective manner if a fine filter, the pressure sensor, a pressure regulator and a non-return valve are formed as a structural unit.

The electrical contacting of the pressure sensor is particularly simple and cost-effective if contact terminals for connecting the pressure sensor to control electronics for demand control of the fuel pump are arranged in a flange which closes off an assembly opening of the fuel tank.

The fuel delivery device according to various embodiments is of particularly simple structural design if the pressure sensor is arranged in a flange of the fuel pump which closes off an assembly opening of the fuel tank.

A fine filter which is often referred to as a lifetime filter is usually arranged on the flange. Here, the fuel delivery device according to various embodiments is of particularly simple structural design if the pressure sensor is arranged between the fuel pump and the fine filter as viewed in the flow direction.

A measuring error of the pressure sensor as a result of a pressure loss caused by a fine filter and/or a non-return valve can be avoided in a simple manner according to another advantageous refinement if the pressure sensor is arranged directly upstream of a connection, which leads away from the flange, of the feed line.

At idle, or during a change in load, the non-return valve can close the fuel pump which is in operation. According to various embodiments, however, it is possible for the pressure generated by the fuel pump to be easily measured even at idle or during a change in load if the pressure sensor is arranged upstream of the non-return valve as viewed in the flow direction. A further advantage of this design is that contamination of a fine filter arranged downstream of the non-return valve is likewise measured.

FIG. 1 schematically shows a fuel delivery device 1 for delivering fuel from a fuel tank 2 to an internal combustion engine 3 of a motor vehicle. The fuel delivery device 1 has a fuel delivery unit 4, which is arranged within the fuel tank 2, and a feed line 6, which leads from the fuel feed unit 4 to an injection rail 5 of the internal combustion engine 3. The fuel delivery unit 4 has a fuel pump 7 with an electric motor 8 and with a pump stage 10 which is arranged within a surge pot 9 which is provided for collecting fuel. The surge pot 9 is braced against the base of the fuel tank 2 and is supported by means of a support 11 against a flange 13 which closes off an assembly opening 12 of the fuel tank 2. Arranged in the flange 13 is a pressure sensor 14 which is connected to a section, which is guided within the fuel tank 2, of the feed line 6. The pressure sensor 14 and the electric motor 8 of the fuel pump are connected by means of electrical lines 15, 16 to control electronics 17. The control electronics 17 receive data from the pressure sensor 14 and activate the fuel pump 7 as a function of the data from the pressure sensor 14.

Figure 2:
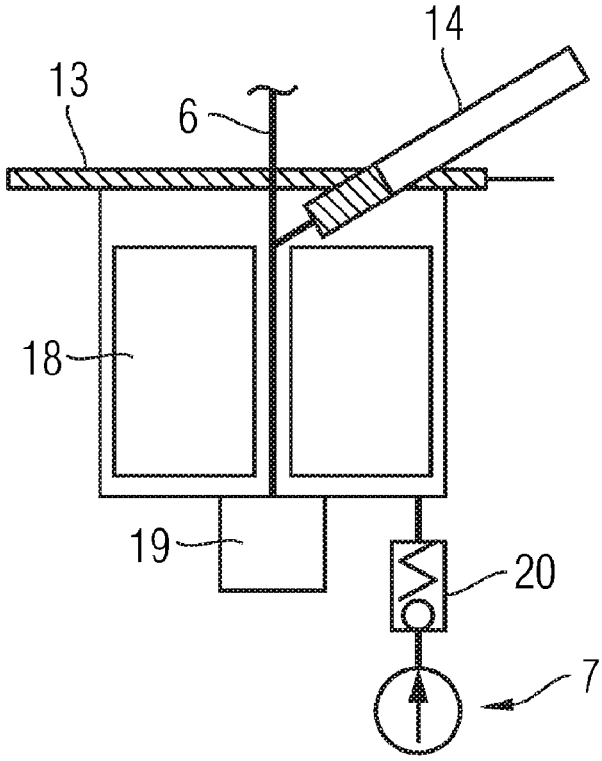

FIG. 2 shows a partial region of a further embodiment of a partial region of the fuel delivery device 1 from FIG. 1, in which a fine filter 18 is arranged on the flange 13. The pressure sensor 14 is arranged on a section, which is guided within the fine filter 18, of the feed line 6. A pressure regulator 19 or a safety valve is arranged upstream of the pressure sensor 14 as viewed in the flow direction. Between the fuel pump 7 and the fine filter 18, the feed line 6 also has a non-return valve 20.

Figure 3:
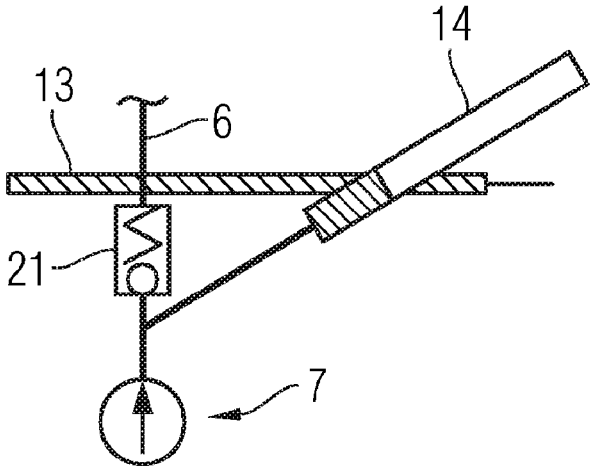

FIG. 3 shows a partial region of a further embodiment of the fuel delivery device 1, which differs from that in FIG. 1 merely in that the pressure sensor 14 is arranged upstream of a non-return valve 21 as viewed in the flow direction.

Figure 4:
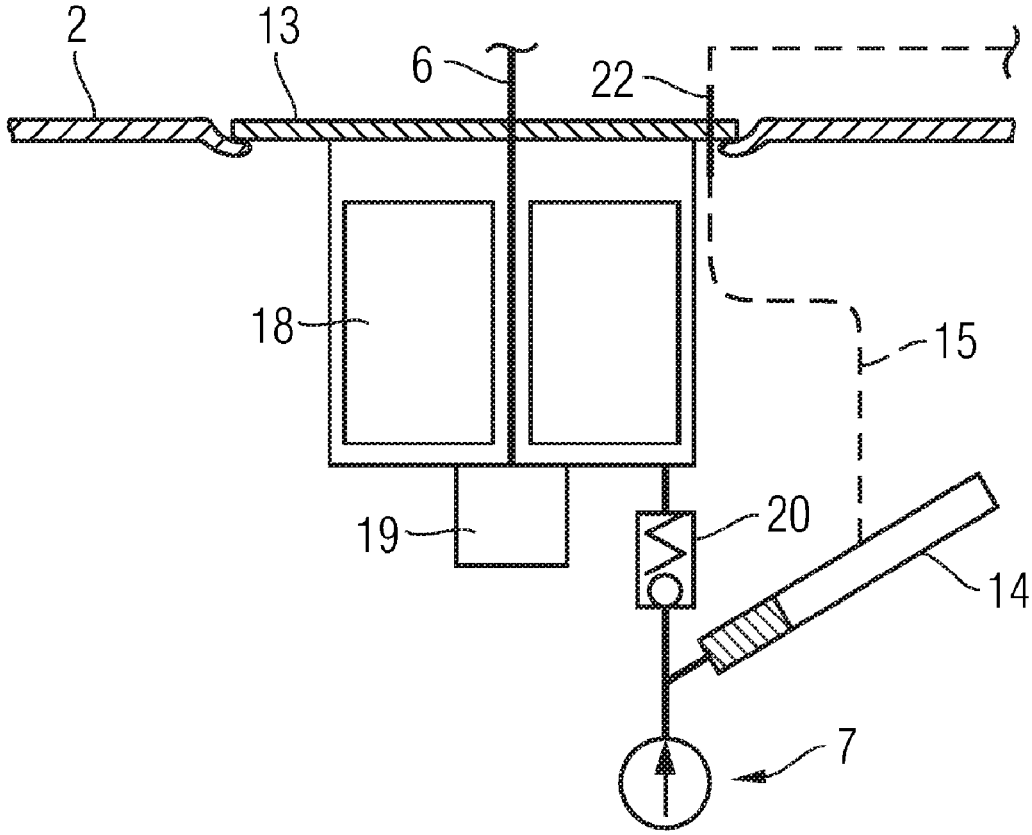

FIG. 4 shows a further embodiment of a partial region of the fuel delivery device 1, which differs from that in FIG. 2 in that the pressure sensor 14 is arranged within the fuel tank 2. Furthermore, the pressure sensor 14 is connected, in a section which is guided between the fuel pump 7 and the non-return valve 20 which is arranged upstream of the fine filter 18, to the feed line 6. The electrical line 15 of the pressure sensor 14 which leads to the control electronics 17 in FIG. 1 has contact terminals 22 guided through the flange 13.

The invention claimed is:

1. A fuel delivery device for supplying an internal combustion engine of a motor vehicle with fuel from a fuel tank, comprising:

an electromotively driven fuel pump which is arranged in the fuel tank, a feed line which is connected to the fuel pump and which leads to the internal combustion engine, a fine filter for filtering the fuel fed to the internal combustion engine, a pressure regulator arranged upstream of the fine filter, and a pressure sensor for determining the pressure of the fuel fed to the internal combustion engine, wherein the pressure sensor is connected to a section of the feed line which is remote from the internal combustion engine, wherein the pressure sensor is arranged between the fuel pump and the fine filter as viewed in the flow direction, and wherein the fine filter is carried in a housing coupled to a flange that is removably secured to the fuel tank to close off an opening of the fuel tank, wherein the flange, housing, and fine filter are removable from the fuel tank together as a flange assembly.

2. The fuel delivery device according to claim 1, wherein the pressure sensor is connected to a section, which is guided within the fuel tank, of the feed line.

3. The fuel delivery device according to claim 1, wherein the pressure sensor is formed as a structural unit with the fuel pump.

4. The fuel delivery device according to claim 1, wherein the fine filter, the pressure sensor, the pressure regulator and a non-return valve are formed as a structural unit.

5. The fuel delivery device according to claim 1, wherein contact terminals for connecting the pressure sensor to control electronics for demand control of the fuel pump are arranged in the flange assembly.

6. The fuel delivery device according to claim 1, wherein the pressure sensor is arranged in the flange assembly.

7. The fuel delivery device according to claim 1, wherein the pressure sensor is arranged directly upstream of a connection, which leads away from the flange, of the feed line.

8. The fuel delivery device according to claim 1, wherein the pressure sensor is arranged upstream of a non-return valve as viewed in the flow direction.

9. A fuel delivery device in a motor vehicle, comprising an electromotively driven fuel pump arranged in a fuel tank, a feed line connected to the fuel pump and leading to an internal combustion engine, a fine filter for filtering the fuel fed to the internal combustion engine, a pressure regulator arranged upstream of the fine filter, and a pressure sensor connected to a section of the feed line being remote from the internal combustion engine, wherein the pressure sensor is arranged between the fuel pump and the fine filter as viewed in the flow direction, and wherein the fine filter is carried in a housing coupled to a flange that is removably secured to the fuel tank to close off an opening of the fuel tank, wherein the flange, housing, and fine filter are removable from the fuel tank together as a flange assembly.

10. The fuel delivery device according to claim 9, wherein the pressure sensor is connected to a section, which is guided within the fuel tank, of the feed line.

11. The fuel delivery device according to claim 9, wherein the pressure sensor is formed as a structural unit with the fuel pump.

12. The fuel delivery device according to claim 9, wherein the fine filter, the pressure sensor, the pressure regulator and a non-return valve are formed as a structural unit.

13. The fuel delivery device according to claim 9, wherein contact terminals for connecting the pressure sensor to control electronics for demand control of the fuel pump are arranged in the flange assembly.

14. The fuel delivery device according to claim 9, wherein the pressure sensor is arranged in the flange assembly.

15. The fuel delivery device according to claim 9, wherein the pressure sensor is arranged directly upstream of a connection, which leads away from the flange, of the feed line.

16. The fuel delivery device according to claim 9, wherein the pressure sensor is arranged upstream of a non-return valve as viewed in the flow direction.

17. A method for supplying an internal combustion engine of a motor vehicle with fuel from a fuel tank, comprising the steps of:

arranging an electromotively driven fuel pump in the fuel tank, connecting a feed line which to the fuel pump, the feed line leading to the internal combustion engine, arranging a fine filter for filtering the fuel fed to the internal combustion engine, wherein the fine filter is carried in a housing coupled to a flange that is removably secured to the fuel tank to close off an opening of the fuel tank, wherein the flange, housing, and fine filter are removable from the fuel tank together as a flange assembly, arranging a pressure regulator upstream of the fine filter, arranging a pressure sensor between the fuel pump and the fine filter as viewed in the flow direction, using the pressure sensor, determining the pressure of the fuel fed to the internal combustion engine at a section of the feed line which is remote from the internal combustion engine, and removing the flange assembly, including the flange, housing, and fine filter, from the fuel tank.

18. The method according to claim 1, wherein the pressure sensor is formed as a structural unit with the fuel pump.

* * * * *